US011945023B2

(12) United States Patent
Noguchi

(10) Patent No.: US 11,945,023 B2
(45) Date of Patent: Apr. 2, 2024

(54) CORE MOLDING METHOD AND CORE MOLDING DEVICE

(71) Applicant: SINTOKOGIO, LTD., Nagoya (JP)

(72) Inventor: Youhei Noguchi, Toyokawa (JP)

(73) Assignee: SINTOKOGIO, LTD., Nagoya (JP)

( * ) Notice: Subject to any disclaimer, the term of this patent is extended or adjusted under 35 U.S.C. 154(b) by 260 days.

(21) Appl. No.: 17/420,197

(22) PCT Filed: Sep. 4, 2019

(86) PCT No.: PCT/JP2019/034833
§ 371 (c)(1),
(2) Date: Jul. 1, 2021

(87) PCT Pub. No.: WO2020/144892
PCT Pub. Date: Jul. 16, 2020

(65) Prior Publication Data

US 2022/0062974 A1 Mar. 3, 2022

(30) Foreign Application Priority Data

Jan. 9, 2019 (JP) ..... 2019-001665

(51) Int. Cl.

| | |
|---|---|
| ***B22C 19/04*** | (2006.01) |
| ***B22C 9/02*** | (2006.01) |
| ***B22C 9/10*** | (2006.01) |
| ***B22C 13/12*** | (2006.01) |

(52) U.S. Cl.
CPC ..... *B22C 19/04* (2013.01); *B22C 9/02* (2013.01); *B22C 9/10* (2013.01)

(58) Field of Classification Search
CPC ..... B22C 19/04; B22C 13/12; B22C 15/24; B22C 9/10; B22C 9/02
USPC .... 164/6, 15, 19, 20, 21, 22, 456, 169, 200, 164/201, 202, 228, 151.4, 154.6, 155.6; 264/40.6
See application file for complete search history.

(56) References Cited

FOREIGN PATENT DOCUMENTS

| | | | | |
|---|---|---|---|---|
| CN | 104043786 | A * | 9/2014 | ..... B22C 9/10 |
| CN | 104169022 | A | 11/2014 | |
| CN | 106238684 | A | 12/2016 | |
| CN | 108687329 | A | 10/2018 | |
| JP | H6-142831 | A | 5/1994 | |
| JP | 2589397 | Y2 | 1/1999 | |
| JP | 2008-149352 | A | 7/2008 | |
| JP | 2009-241094 | A | 10/2009 | |
| JP | 2014-104481 | A | 6/2014 | |

(Continued)

OTHER PUBLICATIONS

Machine translation of CN 104043786 A (Year: 2014).*

(Continued)

*Primary Examiner* — Kevin P Kerns
(74) *Attorney, Agent, or Firm* — Faegre Drinker Biddle & Reath LLP

(57) ABSTRACT

A core molding method is a method of molding a core using a metal mold that is pressure-fed with mulled sand, and includes heating the metal mold such that the temperature of the metal mold reaches a temperature higher than a predetermined baking temperature, pressure-feeding the heated metal mold with the mulled sand, holding the temperature of the metal mold having been pressure-fed with the mulled sand at the baking temperature, and removing the core from the metal mold after the holding.

6 Claims, 5 Drawing Sheets

(56) References Cited

FOREIGN PATENT DOCUMENTS

| | | | |
|---|---|---|---|
| WO | WO-2013/175813 | A1 | 11/2013 |
| WO | WO-2017/068951 | A1 | 4/2017 |

OTHER PUBLICATIONS

International Preliminary Report in Patentability dated Jul. 22, 2021 in International Application No. PCT/JP2019/034833.

C. Zhou et al., "Production and Use of Refractory for Continuous Casting Monolithic Stopper, long nozzle and submersed nozzle," 2015.

Chinese Office Action dated Jan. 18, 2024 in Application No. 201980088135.9.

* cited by examiner

CORE MOLDING METHOD AND CORE MOLDING DEVICE

TECHNICAL FIELD

This disclosure relates to a core molding method and a core molding device.

BACKGROUND ART

Patent Document 1 describes a core molding device, in which mulled sand is put into a metal mold, the metal mold is heated, and the mulled sand is hardened according to the shape of the metal mold. This device includes the metal mold having mold temperature sensors that measure the temperature of the metal mold, a heating device that heats the metal mold, and a temperature adjustor that controls the temperature at which the heating device heats the metal mold. The temperature adjustor sets the heating temperature at each position in the metal mold and causes the heating device to heat the metal mold. The mold temperature sensor gives feedback to the temperature adjustor on the temperature at each position in the metal mold. Based on the feedback, the temperature adjustor appropriately controls the heating temperature at each position in the metal mold.

CITATION LIST

Patent Document

Patent Document 1: Japanese Utility Model Registration No. 2589397

SUMMARY OF INVENTION

Technical Problem

In the core molding device described in Patent Document 1, when mulled sand is pressure-fed into the metal mold, the heat of the metal mold is taken away by the mulled sand, so that the temperature of the metal mold decreases. As the difference between the decreased temperature of the metal mold and a baking temperature of the mulled sand becomes larger, the time taken for the heating device to heat the metal mold to the baking temperature of the mulled sand increases. This means that the time during which the mulled sand is baked at a temperature lower than the baking temperature of the mulled sand increases. If a core is molded under such conditions, the core is likely to stick to the metal mold, which may result in core molding failure.

This disclosure provides a core molding method and a core molding device that keep a core from sticking to a metal mold.

Solution to Problem

A core molding method according to this disclosure is a method of molding a core using a metal mold pressure-fed with mulled sand, and includes a step of heating the metal mold such that the temperature of the metal mold reaches a temperature higher than a predetermined baking temperature, a step of pressure-feeding the heated metal mold with the mulled sand, a step of holding the temperature of the metal mold having been pressure-fed with the mulled sand at the baking temperature, and a step of removing the core from the metal mold after the holding step.

In this method, as the heating step, the metal mold is heated to a temperature higher than the predetermined baking temperature. In the pressure-feeding step, the mulled sand is pressure-fed into the heated metal mold. In the holding step, the temperature of the metal mold having been pressure-fed with the mulled sand is held at the baking temperature that is the temperature of the metal mold at the time of baking the mulled sand. In the removal step, the core is removed from the metal mold after the holding step. Thus, the metal mold is heated to a temperature higher than the baking temperature in the heating step before pressure-feeding of the mulled sand. Therefore, compared with when the metal mold is not heated before pressure-feeding of the mulled sand or when the metal mold is maintained at the baking temperature, this method can keep the temperature of the metal mold from becoming lower than the baking temperature due to pressure-feeding of the mulled sand and keep the difference between the temperature of the metal mold and the baking temperature from becoming large. As a result, compared with when the metal mold is not heated to a temperature higher than the baking temperature before pressure-feeding of the mulled sand, this method can reduce the time during which the mulled sand is baked at a temperature lower than the baking temperature. Thus, this method can keep a core from sticking to a metal mold.

A core molding method according to one embodiment may further include a step of measuring a first temperature of the metal mold at the end of the heating step, and a step of measuring a second temperature of the metal mold at the end of the pressure-feeding step. The heating step, the first temperature measurement step, the pressure-feeding step, the second temperature measurement step, the holding step, and the removal step may be executed sequentially and repeatedly. In the heating step after the removal step, a preliminary temperature of the metal mold may be determined based on the measured first temperature, the measured second temperature, and the baking temperature, and the metal mold may be heated based on the determined preliminary temperature. In this case, the heating step, the first temperature measurement step, the pressure-feeding step, the second temperature measurement step, the holding step, and the removal step are sequentially executed, and these are repeatedly executed as one cycle. In the heating step that is executed as the next cycle after the removal step of one cycle, the preliminary temperature of the metal mold is determined based on the measured first temperature, the measured second temperature, and the baking temperature. In this method, the metal mold is heated based on the preliminary temperature in the heating step in the second and subsequent cycles. The preliminary temperature is determined using a relationship among previous first temperature, second temperature, and baking temperature. Thus, this method can appropriately determine the preliminary temperature using past data.

A core molding method according to one embodiment may further include a step of measuring a first temperature of the metal mold at the end of the heating step. The holding step may include a step of measuring an adjustment time taken to change the temperature of the metal mold having been pressure-fed with the mulled sand to the predetermined baking temperature from the start of temperature control of the metal mold. The heating step, the first temperature measurement step, the pressure-feeding step, the holding step, and the removal step may be executed sequentially and repeatedly. In the heating step after the removal step, a preliminary temperature of the metal mold may be determined based on the measured first temperature and the measured adjustment time, and the metal mold may be heated based on the determined preliminary temperature. In this case, the heating step, the first temperature measurement step, the pressure-feeding step, the holding step, and the removal step are sequentially executed, and these are repeatedly executed as one cycle. In the heating step that is executed as the next cycle after the removal step of one cycle, the preliminary temperature of the metal mold is determined based on the measured first temperature and adjustment time. In this method, the metal mold is heated based on the preliminary temperature in the heating step in the second and subsequent cycles. The preliminary temperature is determined using a relationship between previous first temperature and adjustment time. Thus, this method can appropriately determine the preliminary temperature using past data.

A core molding method according to one embodiment may further include, after the second temperature measurement step, a step of notifying an abnormality when the second temperature is higher than the baking temperature and a difference between the second temperature and the baking temperature is larger than a predetermined first threshold value. If the metal mold is excessively heated in the heating step, the second temperature may become higher than the sum of the baking temperature and the first threshold value even when the mulled sand is pressure-fed into the metal mold in the pressure-feeding step. A core molded in this state may have poor quality compared with a core molded at an appropriate baking temperature. By notifying an abnormality when the above state arises, this method can make known the possibility of the core having poor quality.

A core molding method according to one embodiment may further include a step of heating the mulled sand before the pressure-feeding step. In this case, the mulled sand is heated before the pressure-feeding step, so that the temperature of the metal mold is kept from decreasing in the pressure-feeding step compared with when the mulled sand is not heated. Thus, this method can keep the temperature of the metal mold from becoming lower than the baking temperature due to pressure-feeding of the mulled sand and keep the difference between the temperature of the metal mold and the baking temperature from becoming large. As a result, compared with when the metal mold is not heated to a temperature higher than the baking temperature before pressure-feeding of the mulled sand and the mulled sand is not heated, this method can reduce the time during which the mulled sand is baked at a temperature lower than the baking temperature. Moreover, this method can reduce the amount of heating of the metal mold in the heating step compared with when the mulled sand is not heated.

A core molding device that is another aspect of this disclosure is a device for molding a core using a metal mold pressure-fed with mulled sand, and includes: the metal mold for baking the mulled sand; a pressure-feeding device pressure-feeding the mulled sand into the metal mold; a mold heat controller controlling the temperature of the metal mold; a mold temperature sensor measuring the temperature of the metal mold; and a control unit connected to the pressure-feeding device, the mold heat controller, and the mold temperature sensor. The control unit executes a step of heating the metal mold using the mold heat controller such that the temperature of the metal mold reaches a temperature higher than a predetermined baking temperature, a step of pressure-feeding the mulled sand into the heated metal mold using the pressure-feeding device, a step of holding the temperature of the metal mold having been pressure-fed with the mulled sand at the baking temperature using the mold heat controller and the mold temperature sensor, and a step of removing the core from the metal mold after the holding step.

In this device, as the heating step, the metal mold is heated to a temperature higher than the predetermined baking temperature under control by the mold heat controller controlled by the control unit. In the pressure-feeding step, the mulled sand is pressure-fed into the heated metal mold by the pressure-feeding device controlled by the control unit. In the holding step, the temperature of the metal mold having been pressure-fed with the mulled sand is held by the mold heat controller, the mold temperature sensor, and the control unit at the baking temperature that is the temperature of the metal mold at the time of baking the mulled sand. In the removal step, the core is removed from the metal mold after the holding step. Thus, the metal mold is heated to a temperature higher than the baking temperature by the mold heat controller in the heating step before pressure-feeding of the mulled sand. Therefore, compared with when the metal mold is not heated before pressure-feeding of the mulled sand or when the metal mold is maintained at the baking temperature, this device can keep the temperature of the metal mold from becoming lower than the baking temperature due to pressure-feeding of the mulled sand and keep the difference between the temperature of the metal mold and the baking temperature from becoming large. As a result, compared with when the metal mold is not heated to a temperature higher than the baking temperature before pressure-feeding of the mulled sand, this device can reduce the time during which the mulled sand is baked at a temperature lower than the baking temperature. Thus, this device can keep the core from sticking to the metal mold.

A core molding device according to one embodiment may further include a recording unit connected to the mold temperature sensor and the control unit and recording the temperature of the metal mold. The control unit may further execute a step of measuring a first temperature of the metal mold at the end of the heating step using the mold temperature sensor and recording the first temperature in the recording unit, and a step of measuring a second temperature of the metal mold at the end of the pressure-feeding step using the mold temperature sensor and recording the second temperature in the recording unit. The control unit may sequentially and repeatedly execute the heating step, the first temperature measurement step, the pressure-feeding step, the second temperature measurement step, the holding step, and the removal step. In the heating step after the removal step, the control unit may determine a preliminary temperature of the metal mold based on the first temperature and the second temperature recorded in the recording unit and the baking temperature, and heats the metal mold using the mold heat controller based on the determined preliminary temperature. In this case, the heating step, the first temperature measurement step, the pressure-feeding step, the second temperature measurement step, the holding step, and the removal step are sequentially executed, and these are repeatedly executed as one cycle. In the heating step that is executed as the next cycle after the removal step of one cycle, the preliminary temperature of the metal mold is determined based on the first temperature, the second temperature, and the baking temperature recorded in the recording unit. In this device, the metal mold is heated based on the preliminary temperature in the heating step in the second and subsequent cycles. The preliminary temperature is determined using a relationship among previous first temperature, second temperature, and baking temperature. Thus, this method can appropriately determine the preliminary temperature using past data.

A core molding device according to one embodiment may further include a recording unit connected to the mold temperature sensor and the control unit and recording the temperature of the metal mold and a time corresponding to a change in the temperature of the metal mold. The control unit may further include a step of measuring a first temperature of the metal mold at the end of the heating step using the mold temperature sensor and recording the first temperature in the recording unit. The holding step using the mold temperature sensor may include a step of measuring an adjustment time taken to change the temperature of the metal mold having been pressure-fed with the mulled sand to the predetermined baking temperature from the start of temperature control of the metal mold, and recording the adjustment time in the recording unit. The heating step, the first temperature measurement step, the pressure-feeding step, the holding step, and the removal step may be executed sequentially and repeatedly. In the heating step after the removal step, a preliminary temperature of the metal mold may be determined based on the first temperature and the adjustment time recorded in the recording unit, and the metal mold may be heated using the mold heat controller based on the determined preliminary temperature. In this case, the heating step, the first temperature measurement step, the pressure-feeding step, the holding step, and the removal step are sequentially executed, and these are repeatedly executed as one cycle. In the heating step that is executed as the next cycle after the removal step of one cycle, the preliminary temperature of the metal mold is determined based on the first temperature and the adjustment time recorded in the recording unit. In this device, the metal mold is heated based on the preliminary temperature in the heating step in the second and subsequent cycles. The preliminary temperature is determined using a relationship between previous first temperature and adjustment time. Thus, this device can appropriately determine the preliminary temperature using past data.

A core molding device according to one embodiment may further include a notification unit connected to the control unit and notifying an abnormality. After the second temperature measurement step, the control unit may further execute a step of causing the notification unit to notify an abnormality when the second temperature is higher than the baking temperature and a difference between the second temperature and the baking temperature is larger than a predetermined first threshold value. If the metal mold is excessively heated in the heating step, the second temperature may become higher than the sum of the baking temperature and the first threshold value even when the mulled sand is pressure-fed into the metal mold in the pressure-feeding step. A core molded in this state may have poor quality compared with a core molded at an appropriate baking temperature. By notifying an abnormality when the above state arises, this device can make known the possibility of the core having poor quality.

A core molding device according to one embodiment may further include: a mixing container storing the mulled sand and discharging the mulled sand by the pressure-feeding device; and a mixing container heater connected to the mixing container and the control unit and heating the mixing container. Before the pressure-feeding step, the control unit may further execute a step of heating the mixing container by the mixing container heater to heat the mulled sand. In this case, the mulled sand is heated before the pressure-feeding step, so that the temperature of the metal mold is kept from decreasing in the pressure-feeding step compared with when the mulled sand is not heated. Thus, this device can keep the temperature of the metal mold from becoming lower than the baking temperature due to pressure-feeding of the mulled sand and keep the difference between the temperature of the metal mold and the baking temperature from becoming large. As a result, compared with when the metal mold is not heated to a temperature higher than the baking temperature before pressure-feeding of the mulled sand and the mulled sand is not heated, this device can reduce the time during which the mulled sand is baked at a temperature lower than the baking temperature. Moreover, this device can reduce the amount of heating of the metal mold in the heating step compared with when the mulled sand is not heated.

Advantageous Effects of Invention

The core molding method and the core molding device according to this disclosure can keep a core from sticking to a metal mold.

DESCRIPTION OF EMBODIMENTS

Figure 1:
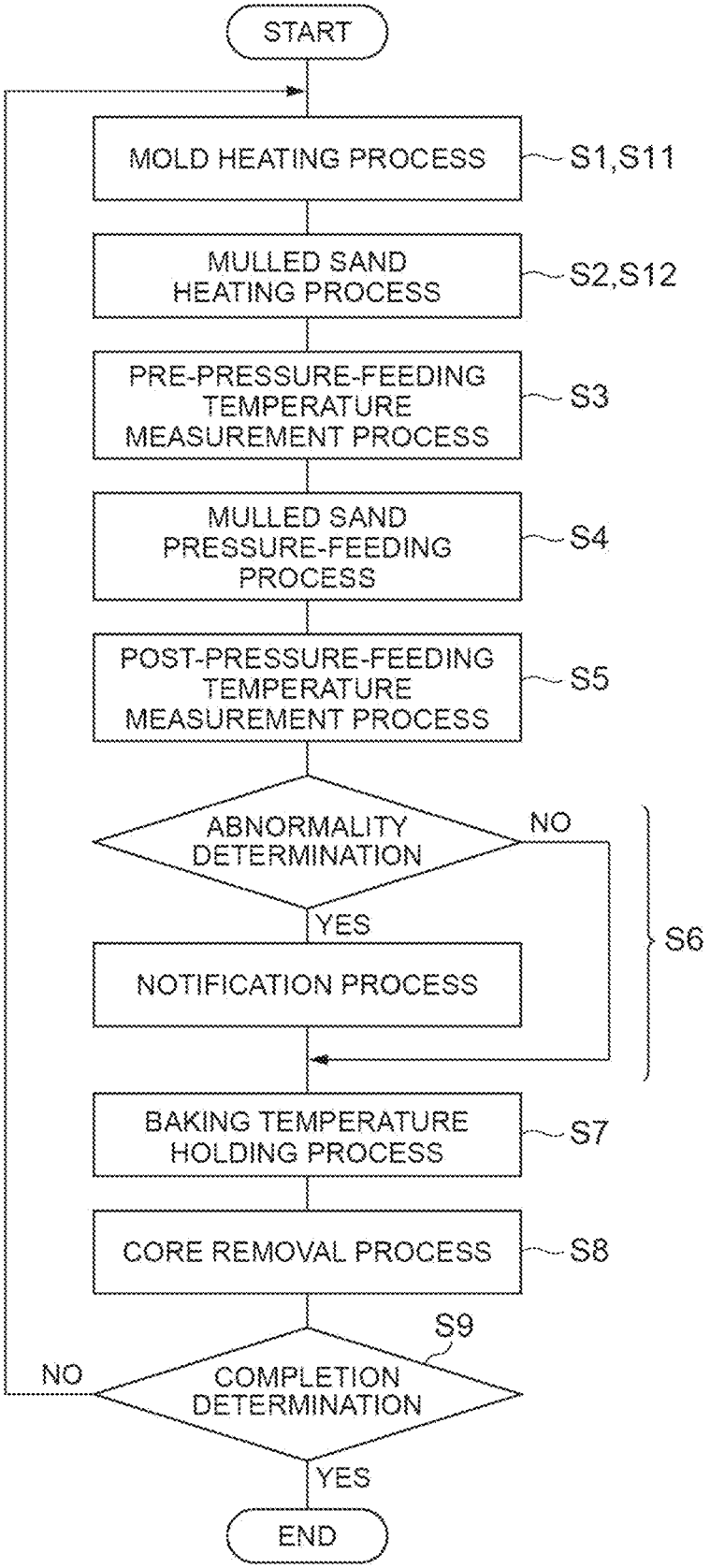
FIG. 1 is a flowchart showing one example of a core molding method according to a first embodiment and a second embodiment.

Embodiments of this disclosure will be described below with reference to the drawings. In the following description, the same or equivalent elements will be denoted by the same reference signs and an overlapping description will not be repeated. The dimensional ratios in the drawings do not necessarily match those in the description. The words "up," "down," "left," and "right" are based on the shown state and for convenience.

First Embodiment

FIG. 1 is a flowchart showing one example of a core molding method according to the embodiments. The core molding method shown in FIG. 1 is a method of molding a core using a metal mold that is pressure-fed with mulled sand. The mulled sand is a raw material for manufacturing a core. The mulled sand is, for example, fire-resistant mineral sand or synthetic sand coated with water glass or mixed with water glass. The mineral sand or the synthetic sand is, for example, alumina sand, silica sand, or zircon sand.

Figure 2:
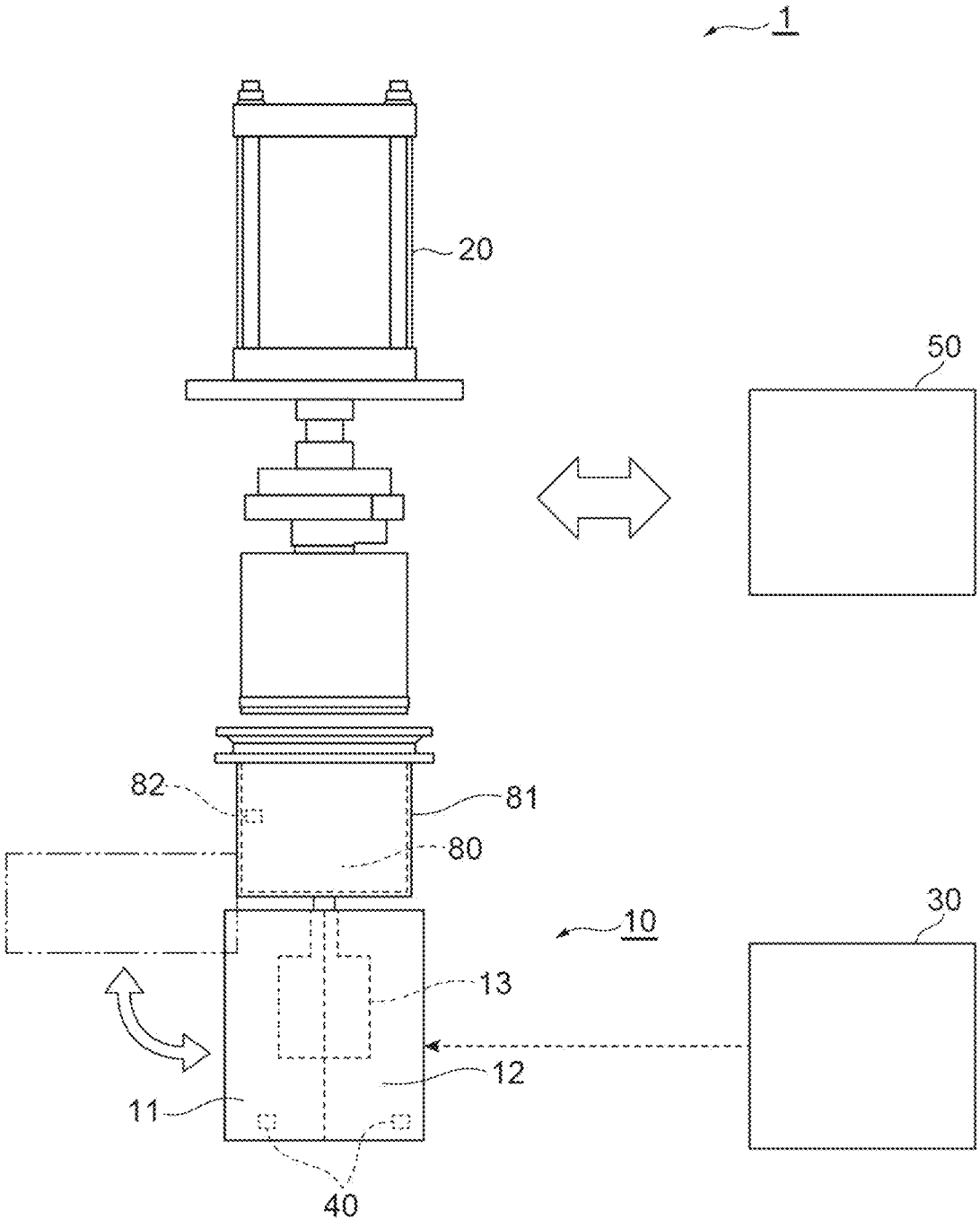
FIG. 2 is a schematic view showing one example of a core molding device according to the first embodiment and the second embodiment.

The mulled sand is pressure-fed into the heated metal mold. The mulled sand is baked inside the metal mold having reached a baking temperature T. The baking temperature T is a temperature at which the mulled sand is baked and which is suitable for molding a core. The baking temperature T is set as appropriate according to the type of mulled sand, core, or metal mold, etc. The core is molded as the mulled sand is baked inside the metal mold and hardens along inner walls of the metal mold. The flowchart shown in FIG. 1 is executed by, for example, a core molding device shown in FIG. 2. FIG. 2 is a schematic view showing one example of the core molding device according to the embodiments.

As shown in FIG. 2, a core molding device 1 includes a metal mold 10, a pressure-feeding device 20, a mold heat controller 30, mold temperature sensors 40, and a control unit 50. The core molding device 1 can include a mixing container 80 and a mixing container heater 81.

The metal mold 10 is a mold for baking the mulled sand. The metal mold 10 has, for example, a left mold 11 and a right mold 12. The metal mold 10 is used with the left mold 11 and the right mold 12 combined. A cavity 13 is defined inside the left mold 11 and the right mold 12 that are combined. To supply the mulled sand into the cavity 13, a mulled sand feed hole is bored at upper parts of the left mold 11 and the right mold 12. The mulled sand is pressure-fed into the cavity 13 through the mulled sand feed hole by the pressure-feeding device 20. The pressure-fed mulled sand is baked as the temperature of the metal mold 10 is maintained at the baking temperature T for a predetermined period. By being baked, the mulled sand hardens and forms a core. The core is molded to the shape of the cavity 13. The molded core is removed from the metal mold 10. For example, the left mold 11 is configured to be able to turn around an upper part thereof after mold release. The core can be removed from the metal mold 10 by turning the left mold 11 such that a lower end of the left mold 11 is separated from a lower end of the right mold 12.

The pressure-feeding device 20 is a device that pressure-feeds the mulled sand into the metal mold 10. The pressure-feeding device 20 is provided, for example, above the metal mold 10. The pressure-feeding device 20 pressure-feeds the mulled sand into the metal mold 10 through the mulled sand feed hole by applying force to the mulled sand from an upper side toward a lower side. The pressure-feeding device 20 is, for example, a piston or an air supply device. The pressure-feeding device 20 pressure-feeds the mulled sand inside the mixing container 80 disposed above the metal mold 10 into the cavity 13 of the metal mold 10.

The mixing container 80 stores the mulled sand and discharges the mulled sand by the pressure-feeding device 20. The mixing container 80 is made of, for example, metal. The mixing container 80 is, for example, a cylindrical structure with a bottom that is open at the upper side, and has, at the bottom, a discharge port having a valve structure that can be opened and closed. The mixing container 80 stores the mulled sand inside. When no force is applied from the upper side, the mulled sand is not discharged through the discharge port at the bottom. When pressure-feeding the mulled sand into the metal mold 10, the mixing container 80 is provided, for example, under the pressure-feeding device 20 and above the metal mold 10. The discharge port of the mixing container 80 is provided close to or in contact with the metal mold 10. According to the force applied from the pressure-feeding device 20, the mixing container 80 discharges the mulled sand stored inside downward through the discharge port and supplies the mulled sand into the cavity 13 of the metal mold 10.

The mixing container heater 81 heats the mixing container 80. The mixing container heater 81 is provided close to or in contact with an outer surface of the mixing container 80. Based on control by the control unit 50, the mixing container heater 81 heats the mixing container 80 to a target temperature. The target temperature is a temperature as a target that is set as appropriate in the control unit 50 to heat the mixing container 80 by the control unit 50 and the mixing container heater 81. The core molding device 1 has, for example, a mixing container temperature sensor 82. The mixing container temperature sensor 82 sends the temperature of the mixing container 80 to the control unit 50.

The mold heat controller 30 controls the temperature of the metal mold 10. The mold heat controller 30 performs heating, lowering of the temperature, or holding of the temperature on each location in the metal mold 10. The mold heat controller 30 may be provided inside the metal mold 10 or may be provided outside the metal mold 10. The mold heat controller 30 is, for example, a heater or a cooling water circulator.

The mold temperature sensors 40 measure the temperature of the metal mold 10. The mold temperature sensors 40 are provided, for example, at a plurality of locations on an outer side of the metal mold 10. The mold temperature sensors 40 output the values of the temperatures at the respective locations in the metal mold 10 once every predetermined time. The mold temperature sensors 40 are, for example, thermocouple sensors. The mold temperature sensors 40 may be non-contact temperature sensors.

The control unit 50 is formed by, for example, a control device such as a computer. Hardware of the control unit 50 is formed by, for example, a circuit (control) board on which a central processing unit (CPU), a read-only memory (ROM), a random-access memory (RAM), an A/D converter circuit, a D/A converter circuit, and a communication interface (I/F) circuit are mounted. The CPU, the ROM, the RAM, the A/D converter circuit, the D/A converter circuit, and the communication I/F circuit are connected to a bus. The A/D converter circuit and the D/A converter circuit are connected to the bus through an input and output I/F circuit.

Figure 3:
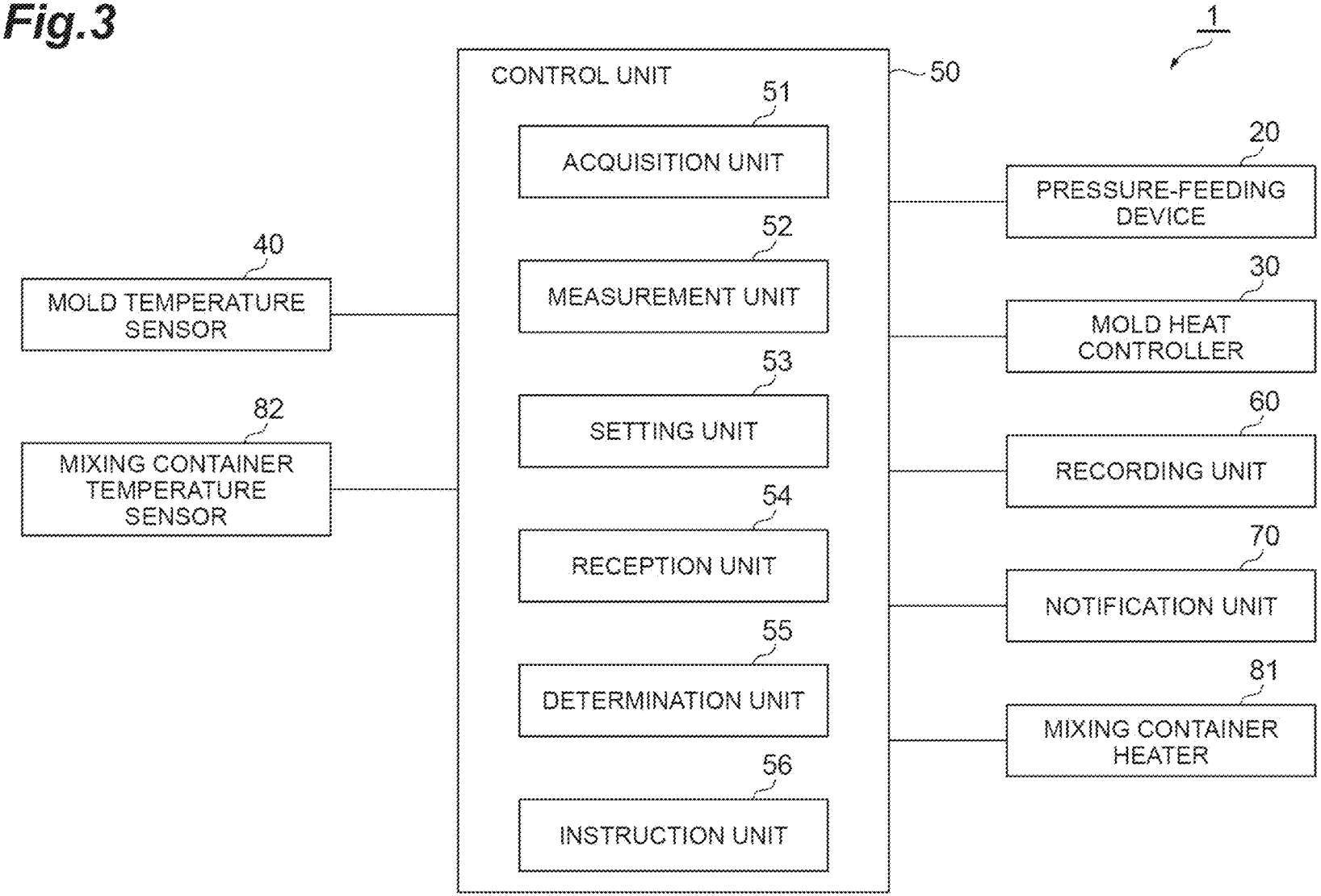
FIG. 3 is a block diagram showing one example of functions of the core molding device according to the first embodiment and the second embodiment.

FIG. 3 is a block diagram showing one example of functions of the core molding device according to the embodiments. As shown in FIG. 3, the control unit 50 has, for example, an acquisition unit 51, a measurement unit 52, a setting unit 53, a reception unit 54, a determination unit 55, and an instruction unit 56. The control unit 50 is connected to the pressure-feeding device 20, the mold heat controller 30, the mold temperature sensors 40, the recording unit 60, the notification unit 70, the mixing container heater 81, and the mixing container temperature sensor 82.

The acquisition unit 51 acquires the temperature of the metal mold 10 measured by the mold temperature sensors 40. The acquisition unit 51 may acquire the temperature of the mixing container 80 measured by the mixing container temperature sensor 82.

The measurement unit 52 measures a time from a predetermined temperature to a predetermined temperature in the metal mold 10 measured by the mold temperature sensors 40. The acquisition unit 51 may be connected to the mixing container temperature sensor 82 and measure a time from a predetermined temperature to a predetermined temperature in the mixing container 80. The measurement unit 52 measures a time from a point when a predetermined process starts to a point when a subsequent predetermined process ends or to a point when the temperature of the metal mold 10 reaches a predetermined temperature. The measurement unit 52 measures a time from a point when a predetermined process ends to a time when a subsequent predetermined process starts or to a point when the temperature of the metal mold 10 reaches a predetermined temperature. The measurement unit 52 measures a time from a point when the temperature of the metal mold 10 reaches a predetermined temperature to a point when a predetermined process starts or to a point when a predetermined process ends.

When there is data on the previous temperature in the recording unit 60, the setting unit 53 determines a preliminary temperature of the metal mold 10 based on at least the previous temperature recorded in the recording unit 60. The preliminary temperature is a temperature serving as a target when heating the metal mold 10 by the mold heat controller 30 before pressure-feeding the mulled sand into the metal mold 10 by the pressure-feeding device 20. The preliminary temperature is a temperature higher than the baking temperature T. The setting unit 53 may determine the preliminary temperature using the temperature of the metal mold 10 acquired by the acquisition unit 51 or the temperature of the mixing container 80 acquired by the acquisition unit 51.

When there is data on the previous temperature in the recording unit 60, the setting unit 53 determines a target temperature of the mixing container 80 based on the previous temperature recorded in the recording unit 60. The target temperature is a temperature serving as a target when preliminarily heating the mixing container 80 by the mixing container heater 81 before pressure-feeding the mulled sand into the metal mold 10 by the pressure-feeding device 20. The setting unit 53 may determine the target temperature using the temperature of the metal mold 10 acquired by the acquisition unit 51, the temperature of the mixing container 80 acquired by the acquisition unit 51, or the time measured by the measurement unit 52.

The reception unit 54 receives an input of the baking temperature T. When there is no data on the previous temperature in the recording unit 60 and the setting unit 53 cannot set the preliminary temperature or the target temperature, the reception unit 54 receives a worker's input of the preliminary temperature or the target temperature. The reception unit 54 may receive an input of a baking time. The baking time is a time from a time when pressure-feeding of the mulled sand into the metal mold 10 ends to a time when baking of the mulled sand in the metal mold 10 ends. The reception unit 54 is, for example, a keyboard or a touch panel. The reception unit 54 may be a touch panel or the like that is integrated with the notification unit 70.

The determination unit 55 compares the temperature of the metal mold 10 acquired by the acquisition unit 51 and the preliminary temperature or the baking temperature T set in the setting unit 53 or the reception unit 54 to determine whether to continue a process by the mold heat controller 30 and the control unit 50. The determination unit 55 compares the temperature of the mixing container 80 acquired by the acquisition unit 51 and the target temperature set in the setting unit 53 or the reception unit 54 to determine whether to continue a process by the mixing container heater 81 and the control unit 50.

Based on a determination result of the determination unit 55, the instruction unit 56 gives an instruction of heating, lowering of the temperature, or holding of the temperature to the mold heat controller 30. Based on a determination result of the determination unit 55, the instruction unit 56 gives an instruction of heating, lowering of the temperature, or holding of the temperature to the mixing container heater 81.

The core molding device 1 can include the recording unit 60. The recording unit 60 records temperatures related to the metal mold 10. The recording unit 60 records, for example, the preliminary temperature, the target temperature, and the baking temperature T. The recording unit 60 may record a time corresponding to a change in the temperature of the metal mold 10, such as the baking time. The recording unit 60 may record temperatures related to the mixing container 80 and a time corresponding to a change in the temperature of the mixing container 80.

The core molding device 1 can include the notification unit 70. The notification unit 70 notifies an abnormality based on instructions from the determination unit 55 and the instruction unit 56. The notification unit 70 notifies a worker of an abnormality in the form of, for example, screen display in a display terminal such as a display, or an output of an alarm sound from a speaker. An abnormality refers to a case where the temperature of the metal mold 10 measured by the mold temperature sensors 40 meets a condition determined by a worker in advance. The notification unit 70 may visualize and display the contents of a process being performed by the control unit 50. A worker can perform an input operation on the reception unit 54 of the control unit 50 after checking the notification unit 70.

In the following, the core molding method will be described with reference to FIG. 1 again. The core molding method is executed in the control unit 50. The control unit 50 can sequentially and repeatedly execute the processes S1 (S11) to S8 as the core molding method. Sequentially executing the processes S1 (S11) to S8 of the core molding method once will be referred to as one cycle. Here, S1 is a mold heating process in a first cycle, and S11 is the mold heating process in second and subsequent cycles. S2 is a mulled sand heating process in the first cycle, and S12 is the mulled sand heating process in the second and subsequent cycles. Before the mold heating process (S1, S11), a process of feeding the mulled sand into the mixing container 80 and mixing the mulled sand may be provided.

In the mold heating process (S1) in the first cycle, the mold heat controller 30 heats the metal mold 10 based on an instruction from the instruction unit 56 of the control unit 50. The preliminary temperature is received in the reception unit 54. The reception unit 54 sends the received preliminary temperature to the determination unit 55 and the recording unit 60. The recording unit 60 records the preliminary temperature.

When it is determined in the determination unit 55 that the temperature of the metal mold 10 acquired by the acquisition unit 51 is lower than the preliminary temperature, the instruction unit 56 causes the mold heat controller 30 to heat the metal mold 10 such that the temperature of the metal mold 10 reaches the preliminary temperature. When it is determined in the determination unit 55 that the temperature of the metal mold 10 acquired by the acquisition unit 51 is equal to or higher than the preliminary temperature, the control unit 50 proceeds to the next process. In this case, for example, the mold heat controller 30 stops heating the metal mold 10 and holds the temperature of the metal mold 10. The determination unit 55 makes the above determination as needed.

In the mulled sand heating process (S2) in the first cycle, the mixing container heater 81 heats the mixing container 80 based on an instruction from the instruction unit 56 of the control unit 50. The target temperature is received in the reception unit 54. The reception unit 54 sends the received target temperature to the determination unit 55 and the recording unit 60. The recording unit 60 records the target temperature.

When it is determined in the determination unit 55 that the temperature of the mixing container 80 acquired by the acquisition unit 51 is lower than the target temperature, the instruction unit 56 causes the mixing container heater 81 to heat the mixing container 80 such that the temperature of the mixing container 80 reaches the target temperature. The mulled sand is heated as the mixing container 80 is heated. The mulled sand is heated, for example, to between 25° C. to 30° C. The mulled sand is heated, for example, with 40° C. as an upper limit.

When it is determined in the determination unit 55 that the temperature of the mixing container 80 acquired by the acquisition unit 51 is equal to or higher than the target temperature, the control unit 50 proceeds to the next process. In this case, the instruction unit 56 causes the mixing container heater 81 to hold the temperature of the mixing container 80. The determination unit 55 makes the above determination as needed. The mulled sand heating process (S2) in the first cycle should be executed at least before a mulled sand pressure-feeding process (S4). The control unit 50 and the mixing container heater 81 may control the temperature of the mixing container 80 also when the mulled sand heating process (S2) and the subsequent processes are being executed.

In a pre-pressure-feeding temperature measurement process (S3), the mold temperature sensors 40 are used and a pre-pressure-feeding temperature (one example of the first temperature) that is the temperature of the metal mold 10 at the end of the mold heating process (S1, S11) is measured and recorded in the recording unit 60. At the end of the mold heating process (S1, S11), the acquisition unit 51 of the control unit 50 acquires the pre-pressure-feeding temperature that is the temperature of the metal mold 10 measured using the mold temperature sensors 40. The acquisition unit 51 sends the pre-pressure-feeding temperature to the recording unit 60. The recording unit 60 records the pre-pressure-feeding temperature. The pre-pressure-feeding temperature measurement process (S3) ends at a point when recording in the recording unit 60 ends, and the control unit 50 proceeds to the next process.

In the mulled sand pressure-feeding process (S4), the pressure-feeding device 20 is used to pressure-feed the mulled sand into the heated metal mold 10. When the control unit 50 proceeds to the mulled sand pressure-feeding process (S4), the mixing container 80 moves based on control by the control unit 50 and is disposed under the pressure-feeding device 20. The pressure-feeding device 20 pressure-feeds the mulled sand from the mixing container 80 into the metal mold 10 based on an amount of pressure-feeding or a time of pressure-feeding of the mulled sand that is determined in advance by the control unit 50.

The pressure-feeding device 20 pressure-feeds the mulled sand into the cavity 13 of the metal mold 10 by, for example, a piston. The mulled sand pressure-feeding process (S4) ends when the predetermined amount of pressure-feeding or time of pressure-feeding of the mulled sand is reached. The pressure-feeding device 20 ends pressure-feeding by control of the control unit 50, and the control unit 50 proceeds to the next process. During the other processes, the mixing container 80 may be disposed under the pressure-feeding device 20.

In a post-pressure-feeding temperature measurement process (S5), the mold temperature sensors 40 are used and a post-pressure-feeding temperature (one example of the second temperature) that is the temperature of the metal mold 10 at the end of the mulled sand pressure-feeding process (S4) is measured and recorded in the recording unit 60. The acquisition unit 51 of the control unit 50 acquires the post-pressure-feeding temperature that is the temperature of the metal mold 10 measured using the mold temperature sensors 40 at the end of the mulled sand pressure-feeding process (S4). The acquisition unit 51 sends the post-pressure-feeding temperature to the recording unit 60. The recording unit 60 records the post-pressure-feeding temperature. The post-pressure-feeding temperature measurement process (S5) ends at a point when recording in the recording unit 60 ends, and the control unit 50 proceeds to the next process.

In an abnormality determination and notification process (S6), after the post-pressure-feeding temperature measurement process (S5), the notification unit 70 notifies an abnormality when the post-pressure-feeding temperature is higher than the baking temperature T and the difference between the post-pressure-feeding temperature and the baking temperature T is larger than a predetermined first threshold value. In the reception unit 54, an input of the first threshold value for the difference between the post-pressure-feeding temperature and the baking temperature T in the case where the post-pressure-feeding temperature is higher than the baking temperature T is received. The first threshold value is set in advance, for example, within a range of 3° C. or more and 10° C. or less. The reception unit 54 sends the first threshold value to the determination unit 55 and the recording unit 60. The determination unit 55 of the control unit 50 compares the baking temperature T and the post-pressure-feeding temperature recorded in the recording unit 60, and determines that there is an abnormality when determining that the post-pressure-feeding temperature is higher than the baking temperature T and the difference between the post-pressure-feeding temperature and the baking temperature T is larger than the first threshold value in the reception unit 54.

When it is determined in the determination unit 55 that there is an abnormality, the instruction unit 56 causes the notification unit 70 to notify the abnormality. When the abnormality has been notified by the notification unit 70 or when it is determined in the determination unit 55 that there is no abnormality, the control unit 50 proceeds to the next process. When it is determined in the determination unit 55 that there is an abnormality, the core is removed from the metal mold 10 and the flowchart shown in FIG. 1 is ended. The recording unit 60 records the first threshold value.

In a baking temperature holding process (S7), the temperature of the metal mold 10 having been pressure-fed with the mulled sand is held at the baking temperature T using the mold heat controller 30 and the mold temperature sensors 40. The baking temperature T received in the reception unit 54 is sent to the determination unit 55 and the recording unit 60. The determination unit 55 compares the temperature of the metal mold 10 acquired by the mold temperature sensors 40 and the acquisition unit 51 and the baking temperature T. When it is determined by the determination unit 55 that the temperature of the metal mold 10 is lower than the baking temperature T, the instruction unit 56 causes the mold heat controller 30 to control the temperature of the metal mold 10 such that the temperature of the metal mold 10 reaches the baking temperature T.

In the baking temperature holding process (S7), the mold heat controller 30 and the control unit 50 hold the temperature of the metal mold 10 so as to be equal to the baking temperature T until a time obtained by adding the baking time to a time at which pressure-feeding of the mulled sand into the metal mold 10 has ended. The baking time is received in advance in the reception unit 54. When it is determined in the determination unit 55 that an elapsed time from when pressure-feeding of the mulled sand into the metal mold 10 has ended that is measured by the measurement unit 52 is shorter than the baking time, the instruction unit 56 holds the temperature of the metal mold 10 so as to be equal to the baking temperature T. When it is determined in the determination unit 55 that the elapsed time from when pressure-feeding of the mulled sand into the metal mold 10 has ended is equal to or longer than the baking time, the control unit 50 proceeds to the next process. When the next cycle is also executed, temperature control of the metal mold 10 by the mold heat controller 30 may be continuously executed. The determination unit 55 makes the above determination as needed. The recording unit 60 records the baking temperature T and the baking time.

In a core removal process (S8), the core is removed from the metal mold 10 after the baking temperature holding process (S7). The core is molded inside the cavity 13 of the metal mold 10 as the mulled sand is baked in the metal mold 10 held at the baking temperature T during a period from the mulled sand pressure-feeding process (S4) to the baking temperature holding process (S7). In the core removal process (S8), the core can be removed from the cavity 13 by turning the left mold 11 such that the lower end of the left mold 11 is separated from the lower end of the right mold 12 after the left mold 11 is released. The core removal process (S8) ends at a point when the core is removed and the left mold 11 is joined to the right mold 12 again, and the control unit 50 proceeds to the next process.

In completion determination (S9), it is determined whether molding of all cores has been completed. Based on the previous record in the recording unit 60, the control unit 50 updates the number of cores having been molded before the completion determination (S9). When it is determined in the control unit 50 that the number of cores has reached the number of pieces to be molded that is determined in advance by the control unit 50, the control unit 50 ends the series of cycle. The core molding device 1 ends molding of cores. When it is determined in the control unit 50 that the number of cores has not reached the number of pieces to be molded, the control unit 50 proceeds to the mold heating process (S11) of the second and subsequent cycles. The recording unit 60 records the number of cores having been molded before the completion determination (S9).

In the mold heating process (S11) of the second and subsequent cycles, the mold heat controller 30 heats the metal mold 10 based on an instruction from the instruction unit 56 of the control unit 50. In the second and subsequent cycles, the setting unit 53 of the control unit 50 sets the preliminary temperature based on the pre-pressure-feeding temperature, the post-pressure-feeding temperature, and the baking temperature T recorded in the recording unit 60. The temperature of the mixing container 80 and the target temperature recorded in the recording unit 60 may be included in determining the preliminary temperature.

In the setting unit 53, the preliminary temperature is set, for example, such that the post-pressure-feeding temperature becomes equal to or lower than the baking temperature T and that the difference between the post-pressure-feeding temperature and the baking temperature T becomes smaller than that in the previous cycle. If the post-pressure-feeding temperature recorded in the recording unit 60 is equal to or lower than the received baking temperature T and the difference between the post-pressure-feeding temperature in one cycle recorded in the recording unit 60 and the received baking temperature T is equal to or smaller than a predetermined second threshold value, the setting unit 53 may use the preliminary temperature of that cycle as the preliminary temperature of the current cycle. The second threshold value is set in advance, for example, within a range from 3° C. or more to 10° C. or less. The setting unit 53 sends the set preliminary temperature to the determination unit 55 and the recording unit 60. Except for the mulled sand heating process (S12) of the second and subsequent cycles, the processes of the second and subsequent cycles after the mold heating process (S11) are the same as the processes of the first cycle after the reception unit 54 sends the preliminary temperature to the determination unit 55 and the recording unit 60 in the mold heating process (S1).

In the mulled sand heating process (S12) of the second and subsequent cycles, the mixing container heater 81 heats the mixing container 80 based on an instruction from the instruction unit 56 of the control unit 50. In the second and subsequent cycles, the setting unit 53 of the control unit 50 sets the target temperature based on the pre-pressure-feeding temperature, the post-pressure-feeding temperature, the baking temperature T, and the target temperature recorded in the recording unit 60. The target temperature is set along with the preliminary temperature, for example, such that the post-pressure-feeding temperature becomes equal to or lower than the baking temperature T and that the difference between the post-pressure-feeding temperature and the baking temperature T becomes smaller than that in the previous cycle. If the post-pressure-feeding temperature recorded in the recording unit 60 is equal to or lower than the received baking temperature T and the difference between the post-pressure-feeding temperature recorded in the recording unit 60 and the received baking temperature T is equal to or smaller than a predetermined second threshold value, the setting unit 53 may use the target temperature of that time as the target temperature for the current cycle.

The setting unit 53 sends the set target temperature to the determination unit 55 and the recording unit 60. The processes of the second and subsequent cycles after the mulled sand heating process (S12) are the same as the processes of the first cycle after the reception unit 54 sends the target temperature to the determination unit 55 and the recording unit 60 in the mulled sand heating process (S2).

Figure 4:
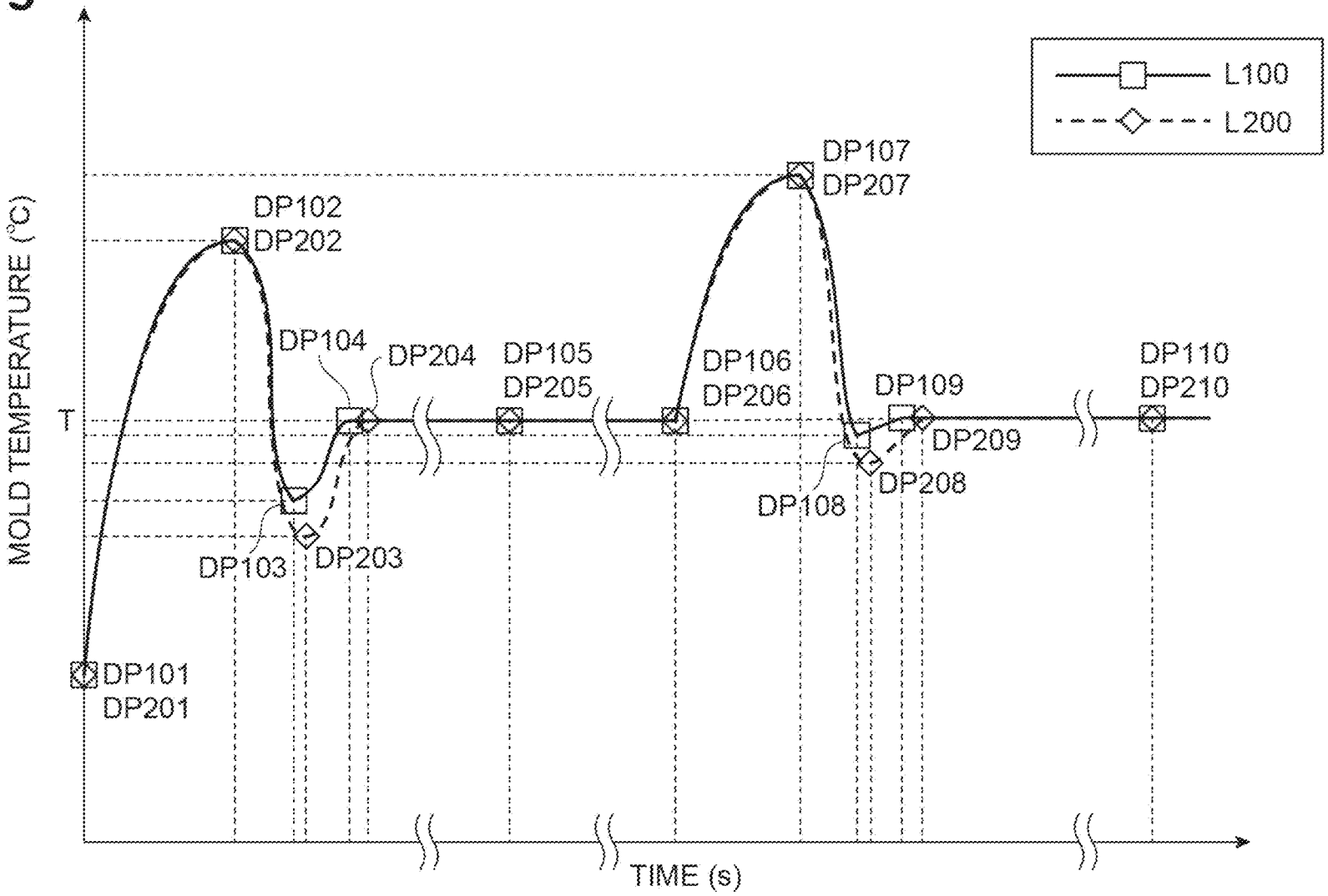
FIG. 4 is a graph showing one example of a case where a post-pressure-feeding temperature is equal to or lower than a baking temperature during a process of change in the temperature of a metal mold of the core molding device according to the first embodiment and the second embodiment.
Figure 5:
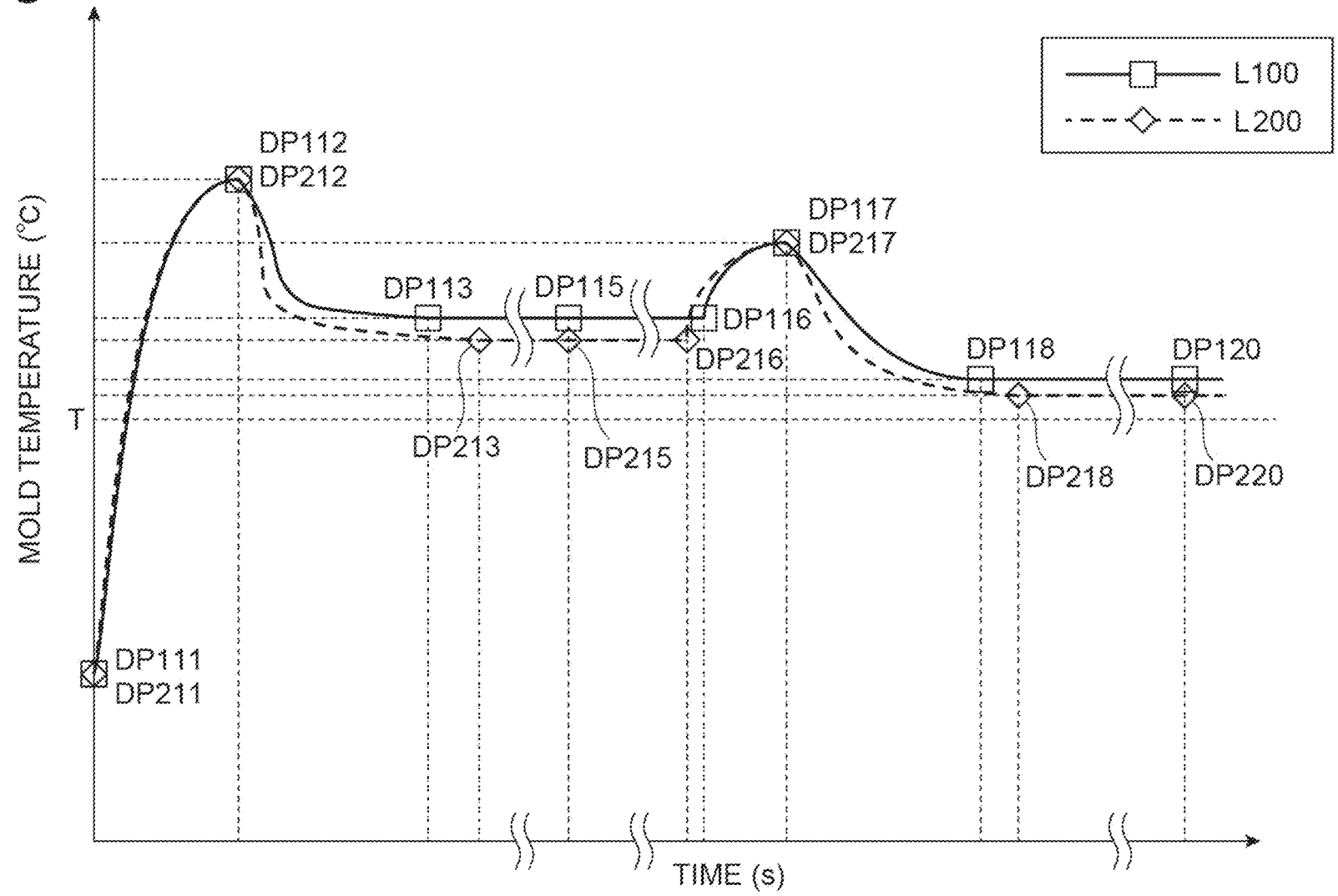
FIG. 5 is a graph showing one example of a case where the post-pressure-feeding temperature is higher than the baking temperature during the process of change in the temperature of the metal mold of the core molding device according to the first embodiment and the second embodiment.

FIG. 4 is a graph showing one example of a case where the post-pressure-feeding temperature is equal to or lower than the baking temperature T during the process of change in the temperature of the metal mold of the core molding device according to the embodiments. FIG. 5 is s a graph showing one example of a case where the post-pressure-feeding temperature is higher than the baking temperature T during the process of change in the temperature of the metal mold of the core molding device according to the embodiments. In FIG. 4 and FIG. 5, the abscissa represents a time (s) from the start of temperature control of the metal mold 10 and the ordinate represents the temperature (° C.) of the metal mold 10. T indicated on the ordinate in FIG. 4 and FIG. 5 denotes the baking temperature T.

In FIG. 4 and FIG. 5, a mulled sand heating line L100 and a mulled sand no-heating line L200 are depicted. The mulled sand heating line L100 is a curve showing changes over time in the temperature of the metal mold 10 obtained from the mold heating process (S1) of the first cycle to the core removal process (S8) of the second and subsequent cycles. The mulled sand no-heating line L200 is a curve showing changes over time in the temperature of the metal mold 10 obtained from the mold heating process (S1) of the first cycle to the core removal process (S8) of the second and subsequent cycles except for the mulled sand heating process (S2, S12). In the mulled sand heating line L100 and the mulled sand no-heating line L200, the baking temperature T is the same in each of FIG. 4 and FIG. 5. On the mulled sand heating line L100, as one example of a result of execution of the processes, a measurement point DP101, a measurement point DP102, a measurement point DP103, a measurement point DP104, a measurement point DP105, a measurement point DP106, a measurement point DP107, a measurement point DP108, a measurement point DP109, and a measurement point DP110 are plotted in FIG. 4, and a measurement point DP111, a measurement point DP112, a measurement point DP113, a measurement point DP115, a measurement point DP116, a measurement point DP117, a measurement point DP118, and a measurement point DP120 are plotted in FIG. 5. On the mulled sand no-heating line L200, as one example of a result of execution of the processes, a measurement point DP201, a measurement point DP202, a measurement point DP203, a measurement point DP204, a measurement point DP205, a measurement point DP206, a measurement point DP207, a measurement point DP208, a measurement point DP209, and a measurement point DP210 are plotted in FIG. 4, and a measurement point DP211, a measurement point DP212, a measurement point DP213, a measurement point DP215, a measurement point DP216, a measurement point DP217, a measurement point DP218, and a measurement point DP220 are plotted in FIG. 5.

The measurement point DP101 and the measurement point DP201 in FIG. 4 and the measurement point DP111 and the measurement point DP211 in FIG. 5 show the temperature at the start of the mold heating process (S1) of the first cycle. The measurement point DP102 and the measurement point DP202 in FIG. 4 and the measurement point DP112 and the measurement point DP212 in FIG. 5 show the pre-pressure-feeding temperature that is the temperature at the end of the mold heating process (S1) of the first cycle measured in the pre-pressure-feeding temperature measurement process (S3).

The measurement point DP103 and the measurement point DP203 in FIG. 4 and the measurement point DP113 and the measurement point DP213 in FIG. 5 show the post-pressure-feeding temperature that is the temperature at the end of the mulled sand pressure-feeding process (S4) of the first cycle measured in the post-pressure-feeding temperature measurement process (S5). The measurement point DP104 and the measurement point DP204 in FIG. 4 show the baking temperature T at the time when the baking temperature T is reached during the baking temperature holding process (S7) of the first cycle. The measurement point DP105 and the measurement point DP205 in FIG. 4 and the measurement point DP115 and the measurement point DP215 in FIG. 5 show the temperature during the core removal process (S8) of the first cycle.

The measurement point DP106 and the measurement point DP206 in FIG. 4 and the measurement point DP116 and the measurement point DP216 in FIG. 5 show the temperature at the start of the mold heating process (S11) of the second and subsequent cycles. The measurement point DP107 and the measurement point DP207 in FIG. 4 and the measurement point DP117 and the measurement point DP217 in FIG. 5 show the pre-pressure-feeding temperature that is the temperature at the end of the mold heating process (S11) of the second and subsequent cycles measured in the pre-pressure-feeding temperature measurement process (S3).

The measurement point DP108 and the measurement point DP208 in FIG. 4 and the measurement point DP118 and the measurement point DP218 in FIG. 5 show the post-pressure-feeding temperature that is the temperature at the end of the mulled sand pressure-feeding process (S4) of the second and subsequent cycles measured in the post-pressure-feeding temperature measurement process (S5). The measurement point DP109 and the measurement point DP209 in FIG. 4 show the baking temperature T at the time when the baking temperature T is reached during the baking temperature holding process (S7) of the second and subsequent cycles. The measurement point DP110 and the measurement point DP210 in FIG. 4 and the measurement point DP120 and the measurement point DP220 in FIG. 5 show the temperature during the core removal process (S8) of the second and subsequent cycles.

As shown in FIG. 4, in the mold heating process (S11) of the second and subsequent cycles, the preliminary temperature is appropriately determined by the setting unit 53 based on the pre-pressure-feeding temperature, the post-pressure-feeding temperature, and the baking temperature T recorded in the recording unit 60. Thus, the difference between the temperature at the measurement point DP108 and the baking temperature T becomes small compared with the difference between the temperature at the measurement point DP103 and the baking temperature T. The time from the measurement point DP108 to the measurement point DP109 on the mulled sand heating line L100 becomes short compared with the time from the measurement point DP103 to the measurement point DP104 on the mulled sand heating line L100. The difference between the temperature at the measurement point DP208 and the baking temperature T becomes small compared with the difference between the temperature at the measurement point DP203 and the baking temperature T. The time from the measurement point DP208 to the measurement point DP209 on the mulled sand no-heating line L200 becomes short compared with the time from the measurement point DP203 to the measurement point DP204 on the mulled sand no-heating line L200. As the preliminary temperature is appropriately set by the mold heating process (S11) of the second and subsequent cycles, the time during which the mulled sand is baked at a temperature lower than the baking temperature T can be reduced.

When the mulled sand is heated by the mulled sand heating process (S2) before the mulled sand pressure-feeding process (S4), the post-pressure-feeding temperature of the metal mold 10 is kept from decreasing in the mulled sand pressure-feeding process (S4) compared with when the mulled sand is not heated. Thus, the temperature at the measurement point DP103 becomes high compared with the temperature at the measurement point DP203. The temperature at the measurement point DP108 becomes high compared with the temperature at the measurement point DP208. The time from the measurement point DP103 to the measurement point DP104 on the mulled sand heating line L100 becomes short compared with the time from the measurement point DP203 to the measurement point DP204 on the mulled sand no-heating line L200. The time from the measurement point DP108 to the measurement point DP109 on the mulled sand heating line L100 becomes short compared with the time from the measurement point DP208 to the measurement point DP209 on the mulled sand no-heating line L200. Thus, as the mulled sand is heated by the mulled sand heating process (S2), compared with when the mulled sand is not heated, the post-pressure-feeding temperature can be kept from becoming lower than the baking temperature T and the difference between the post-pressure-feeding temperature and the baking temperature T can be kept from becoming large. As a result, the time during which the mulled sand is baked at a temperature lower than the baking temperature T can be reduced.

In the mulled sand heating process (S12) of the second and subsequent cycles, the target temperature is appropriately set by the setting unit 53 based on the pre-pressure-feeding temperature, the post-pressure-feeding temperature, the baking temperature T, and the target temperature recorded in the recording unit 60. The difference between the temperature at the measurement point DP108 and the baking temperature T becomes small compared with the difference between the temperature at the measurement point DP103 and the baking temperature T, due to the preliminary temperature determined in the mold heating process (S11) of the second and subsequent cycles and the target temperature determined in the mulled sand heating process (S12) of the second and subsequent cycles. The time from the measurement point DP108 to the measurement point DP109 on the mulled sand heating line L100 becomes short compared with the time from the measurement point DP103 to the measurement point DP104 on the mulled sand heating line L100. As the target temperature is appropriately determined by the mulled sand heating process (S12) of the second and subsequent cycles, the time during which the mulled sand is baked at a temperature lower than the baking temperature T can be reduced.

FIG. 5 shows changes in the temperature of the metal mold 10 in a case where the mold heat controller 30 has only a heating function like a heater, for example, and does not have a cooling function. As shown in FIG. 5, even when the temperature of the metal mold 10 has decreased to the post-pressure-feeding temperature after the mulled sand pressure-feeding process (S4), the temperature of the metal mold 10 may become higher than the baking temperature T as at the measurement point DP113, the measurement point DP213, the measurement point DP118, and the measurement point DP218. The baking temperature T is a temperature lower than the temperatures at the measurement point DP218 and the measurement point DP220, and is the temperature indicated by the dashed line in FIG. 5. These show a state where, if the metal mold 10 is excessively heated in the mold heating process (S1, S11), the post-pressure-feeding temperature becomes higher than the sum of the baking temperature T and the first threshold value even when the mulled sand is pressure-fed into the metal mold 10 in the pressure-feeding step. A core molded in this state may have poor quality compared with a core molded at an appropriate baking temperature T. When this state arises, the notification unit 70 can notify an abnormality to thereby make known the possibility of the core having poor quality.

In the mold heating process (S11) of the second and subsequent cycles, the preliminary temperature is determined using the data recorded in the recording unit 60. In the case where the preliminary temperature is updated, even when the post-pressure-feeding temperature does not become lower than the baking temperature T, the difference between the temperature at the measurement point DP118 and the baking temperature T becomes small compared with the difference between the temperature at the measurement point DP113 and the baking temperature T. The difference between the temperature at the measurement point DP218 and the baking temperature T becomes small compared with the difference between the temperature at the measurement point DP213 and the baking temperature T.

In the mulled sand heating process (S12) of the second and subsequent cycles, the target temperature is determined using the data recorded in the recording unit 60. As a result of temperature adjustment of the mulled sand, the difference between the temperature at the measurement point DP118 and the temperature at the measurement point DP218 becomes small compared with the difference between the temperature at the measurement point DP113 and the temperature at the measurement point DP213.

In the next cycle, feedback is performed using the record of the result of the current cycle, and the preliminary temperature and the target temperature are set such that the post-pressure-feeding temperature becomes lower than the baking temperature T. As feedback is repeated in the mold heating process (S11) and the mulled sand heating process (S12) of the second and subsequent cycles, the metal mold 10 is heated based on the appropriately set preliminary temperature and the mulled sand inside the mixing container 80 having been heated to an appropriately set target temperature is pressure-fed, which can reduce the occurrence of molding of a core that has been baked in a state where the temperature of the metal mold 10 is higher than the baking temperature T.

Thus, the core molding method and the core molding device 1 of this embodiment can keep the core from sticking to the metal mold 10. Compared with when the metal mold 10 is not heated before pressure-feeding of the mulled sand or when the metal mold 10 is maintained at the baking temperature T, the mold heating process (S1, S11) can keep the temperature of the metal mold 10 from becoming lower than the baking temperature T due to pressure-feeding of the mulled sand and keep the difference between the temperature of the metal mold 10 and the baking temperature T from becoming large. Compared with when the metal mold 10 is not heated to a temperature higher than the baking temperature T before pressure-feeding of the mulled sand, the time during which the mulled sand is baked at a temperature lower than the baking temperature T can be reduced.

The preliminary temperature can be appropriately determined using past data by sequentially and repeatedly executing the mold heating process (S1, S11), the pre-pressure-feeding temperature measurement process (S3), the mulled sand pressure-feeding process (S4), the post-pressure-feeding temperature measurement process (S5), the baking temperature holding process (S7), and the core removal process (S8). As the metal mold 10 is heated based on the appropriately set preliminary temperature, the time during which the mulled sand is baked at a temperature different from the baking temperature T can be reduced from the previous time.

The abnormal determination and notification process (S6) is executed, and when the post-pressure-feeding temperature is higher than the baking temperature T and the difference between the post-pressure-feeding temperature and the baking temperature T is larger than the first threshold value, an abnormality can be notified to thereby make known the possibility of the core having poor quality. Executing the mulled sand heating process (S2, S12) can keep the temperature of the metal mold 10 from becoming lower than the baking temperature T due to pressure-feeding of the mulled sand and keep the difference between the temperature of the metal mold 10 and the baking temperature T from becoming large. Compared with when the metal mold 10 is not heated to a temperature higher than the baking temperature T before pressure-feeding of the mulled sand, and the mulled sand is not heated, the time during which the mulled sand is baked at a temperature lower than the baking temperature T can be reduced. Moreover, this method can reduce the amount of heating of the metal mold 10 by the mold heat controller 30 in the mold heating process (S1, S11) compared with when the mulled sand is not heated.

Second Embodiment

Next, a core molding device according to a second embodiment will be described. In the description of this embodiment, differences from the first embodiment will be described and an overlapping description will be omitted. The core molding device according to the second embodiment is different from the core molding device 1 according to the first embodiment in that the post-pressure-feeding temperature measurement process (S5) is not executed in the control unit 50; that the abnormality determination and notification process (S6) is not executed in the control unit 50; and that the control unit 50 sets the preliminary temperature and the target temperature of the second and subsequent cycles based on a measured time.

FIG. 1 is referred to again. Before the baking temperature holding process (S7) ends, the control unit 50 executes an adjustment time measurement process within the baking temperature holding process (S7). The adjustment time measurement process is concurrently performed while the baking temperature holding process (S7) of holding the temperature of the metal mold 10 at the baking temperature T is executed. The adjustment time is a time from when the mold heating process (S1, S11) starts to when the temperature of the metal mold 10 reaches the baking temperature T after the mulled sand pressure-feeding process (S4). The adjustment time is a time measured by the measurement unit 52 based on the temperature measured by the mold temperature sensors 40. The adjustment time is recorded by the recording unit 60.

The measurement unit 52 measures the adjustment time in the adjustment time measurement process within the baking temperature holding process (S7). The measurement unit 52 sends the measured adjustment time to the recording unit 60. The recording unit 60 records the adjustment time. The adjustment time measurement process ends at a point when recording in the recording unit 60 ends, and the control unit 50 continues the baking temperature holding process (S7) of holding the temperature of the metal mold 10 at the baking temperature T. The processes in the current cycle after the adjustment time measurement process are the same as the processes during and after the baking temperature holding process (S7).

In the mold heating process (S11) of the second and subsequent cycles, the mold heat controller 30 heats the metal mold 10 based on an instruction from the instruction unit 56 of the control unit 50. In the second and subsequent cycles, the setting unit 53 of the control unit 50 determines the preliminary temperature based on the pre-pressure-feeding temperature and the adjustment time recorded in the recording unit 60. The temperature of the mixing container 80 and the target temperature recorded in the recording unit 60 may be included in determining the preliminary temperature.

In the setting unit 53, the preliminary temperature is set, for example, such that the adjustment time becomes short compared with the adjustment time of the previous cycle. The adjustment time is set such that the difference from the shortest adjustment time that is the shortest adjustment time determined in advance becomes equal to or smaller than a third threshold value. The shortest adjustment time and the third threshold value are received in the reception unit 54. The third threshold value is, for example, 10 seconds. If the difference between the adjustment time of one cycle recorded in the recording unit 60 and the shortest adjustment time is equal to or smaller than the third threshold value, the setting unit 53 may use the preliminary temperature of that cycle as the preliminary temperature of the current cycle. The setting unit 53 sends the set preliminary temperature to the determination unit 55 and the recording unit 60. Except for the mulled sand heating process (S12) of the second and subsequent cycles, the processes of the second and subsequent cycles after the mold heating process (S11) are the same as the processes of the first cycle after the reception unit 54 sends the preliminary temperature to the determination unit 55 and the recording unit 60 in the mold heating process (S1).

In the mulled sand heating process (S12) of the second and subsequent cycles, the mixing container heater 81 heats the mixing container 80 based on an instruction from the instruction unit 56 of the control unit 50. In the second and subsequent cycles, the setting unit 53 of the control unit 50 sets the target temperature based on the pre-pressure-feeding temperature, the adjustment time, and the target temperature recorded in the recording unit 60. The target temperature is set along with the preliminary temperature, for example, such that the adjustment time becomes short compared with the adjustment time of the previous cycle. The adjustment time is set such that the difference from the shortest adjustment time that is the shortest adjustment time determined in advance becomes equal to or smaller than the third threshold value. If the difference between the adjustment time of one cycle recorded in the recording unit 60 and the shortest adjustment time is equal to or smaller than the third threshold value, the setting unit 53 may use the target temperature of that cycle as the target temperature of the current cycle.

The setting unit 53 sends the set target temperature to the determination unit 55 and the recording unit 60. The processes of the second and subsequent cycles after the mulled sand heating process (S12) are the same as the processes of the first cycle after the reception unit 54 sends the target temperature to the determination unit 55 and the recording unit 60 in the mulled sand heating process (S2).

FIG. 4 is referred to again. As shown in FIG. 4, the adjustment time is the time from the measurement point DP101 to the measurement point DP104, the time from the measurement point DP201 to the measurement point DP204, the time from the measurement point DP106 to the measurement point DP109, and the time from the measurement point DP206 to the measurement point DP209.

In the mold heating process (S11) of the second and subsequent cycles, the preliminary temperature is appropriately determined by the setting unit 53 based on the pre-pressure-feeding temperature and the adjustment time recorded in the recording unit 60. In the mold heating process (S11) of the second and subsequent cycles, the target temperature is appropriately determined by the setting unit 53 based on the pre-pressure-feeding temperature, the adjustment time, and the target temperature recorded in the recording unit 60. The workings and effects achieved by these are the same as those of the core molding device 1 according to the first embodiment.

MODIFIED EXAMPLES

While various illustrative embodiments have been described above, this disclosure is not limited to the above-described illustrative embodiments and various omissions, substitutions, and changes may be made. For example, as the core molding method, the control unit 50 need not execute the mulled sand heating process (S2), the pre-pressure-feeding temperature measurement process (S3), the post-pressure-feeding temperature measurement process (S5), the abnormality determination and notification process (S6), the adjustment time measurement process within the baking temperature holding process (S7), the completion determination (S9), the mold heating process (S11) of the second and subsequent cycles, or the mulled sand heating process (S12) of the second and subsequent cycles. As the core molding method, the control unit 50 need not repeatedly execute the processes S1 (S11) to S8.

The order of the mold heating process (S1, S11) and the mulled sand heating process (S2, S12) may be reversed. In this case, when the setting unit 53 determines the preliminary temperature, the setting unit 53 can determine it using the temperature of the mixing container 80 and the target temperature recorded in the recording unit 60 in addition to the temperature of the metal mold 10 at the current point, the pre-pressure-feeding temperature, the post-pressure-feeding temperature, the adjustment time, and the baking temperature T recorded in the recording unit 60, etc. When the setting unit 53 determines the target temperature, the setting unit 53 can determine it using the pre-pressure-feeding temperature, the post-pressure-feeding temperature, the adjustment time, and the baking time T recorded in the recording unit 60 in addition to the temperature of the mixing container 80 at the current point, the target temperature recorded in the recording unit 60, etc. The mold heating process (S1, S11) and the mulled sand heating process (S2, S12) may be concurrently executed.

A cleaning process may be executed before the mold heating process (S1, S11) is executed and before the metal mold 10 is closed by joining the left mold 11 and the right mold 12 together. In the cleaning process, the inside of the metal mold 10 is cleaned by blowing air, and parting agent (e.g., silicone-dispersed liquid) is sprayed inside the metal mold 10. This makes it easy to remove the core from the metal mold 10.

The mixing container heater 81 may be a mixing container heat controller. In this case, the mixing container heat controller has a function of heating the mixing container 80 and a function of cooling it. In the mulled sand heating process (S2, S12), the mixing container heat controller heats or cools the mixing container 80 based on an instruction from the instruction unit 56 of the control unit 50. In the mulled sand pressure-feeding process (S4), the pressure-feeding device 20 may move based on control by the control unit 50 and be disposed above the mixing container 80.

The mold heating process (S11) of the second and subsequent cycles and the mulled sand heating process (S12) of the second and subsequent cycles may determine the preliminary temperature or the target temperature by using the adjustment time in addition to the pre-pressure-feeding temperature, the post-pressure-feeding temperature, and the baking temperature T. The mulled sand heating process (S2, S12) may determine the target temperature based also on the type of mulled sand. The post-pressure-feeding temperature may be the lowest temperature before a predetermined time determined in advance has elapsed since pressure-feeding of the mulled sand.

The reception unit 54 may receive an input of the preliminary temperature in the mold heating process (S11) of the second and subsequent cycles. When the preliminary temperature has not been set in the setting unit 53, the reception unit 54 sends the received preliminary temperature to the instruction unit 56. In this case, if the preliminary temperature set by the setting unit 53 and the preliminary temperature received by the reception unit 54 are set in an overlapping manner and the set temperatures are different from each other, the reception unit 54 notifies a worker of the difference through the notification unit 70. The reception unit 54 lets the worker choose whether to send the preliminary temperature received in the reception unit 54 to the instruction unit 56. When it is chosen to send the preliminary temperature received in the reception unit 54, the reception unit 54 sends the preliminary temperature received in the reception unit 54 to the instruction unit 56. When it is chosen not to instruct the preliminary temperature received in the reception unit 54, the setting unit 53 sends the preliminary temperature set in the setting unit 53 to the instruction unit 56.

The reception unit 54 may receive an input of the target temperature in the mulled sand heating process (S12) of the second and subsequent cycles. When the target temperature has not been set in the setting unit 53, the reception unit 54 sends the received target temperature to the instruction unit 56. In this case, if the target temperature set by the setting unit 53 and the target temperature received by the reception unit 54 are set in an overlapping manner and the set temperatures are different from each other, the reception unit 54 notifies a worker of the difference through the notification unit 70. The reception unit 54 lets the worker choose whether to send the target temperature received in the reception unit 54 to the instruction unit 56. When it is chosen to send the target temperature received in the reception unit 54, the reception unit 54 sends the target temperature received in the reception unit 54 to the instruction unit 56. When it is chosen not to instruct the target temperature received in the reception unit 54, the setting unit 53 sends the target temperature set in the setting unit 53 to the instruction unit 56.

The setting unit 53 or the reception unit 54 may determine a preliminary temperature heating time based on the temperature of the metal mold 10 or the temperature of the mixing container 80 acquired by the acquisition unit 51; the time measured by the measurement unit 52; or the previous temperature, baking time, etc. such as the pre-pressure-feeding temperature, the post-pressure-feeding temperature, or the baking temperature T recorded in the recording unit 60. In the mold heating process (S1, S11), the control unit 50 causes the mold heat controller 30 to heat the metal mold 10 such that the temperature of the metal mold 10 reaches the preliminary temperature. In this case, the control unit 50 causes the mold heat controller 30 to heat the metal mold 10 until the preliminary temperature heating time has elapsed since the start of temperature control of the metal mold 10. When the preliminary temperature heating time has elapsed since the start of temperature control of the metal mold 10, the pre-pressure-feeding temperature measurement process (S3) may be executed and the temperature of the metal mold 10 at that point may be regarded as the pre-pressure-feeding temperature.

The setting unit 53 or the reception unit 54 may determine a target temperature heating time based on the temperature of the metal mold 10 or the temperature of the mixing container 80 acquired by the acquisition unit 51; the time measured by the measurement unit 52; or the previous temperature, baking time, etc. such as the pre-pressure-feeding temperature, the post-pressure-feeding temperature, or the baking temperature T recorded in the recording unit 60. In the mulled sand heating process (S2, S12), the control unit 50 causes the mixing container heater 81 to heat the mixing container 80 such that the temperature of the mixing container 80 reaches the target temperature. In this case, the control unit 50 causes the mixing container heater 81 to heat the mixing container 80 until the target temperature heating time has elapsed since the start of temperature control of the mixing container 80.

In the abnormality determination and notification process (S6), an abnormality may be notified by the notification unit 70 based on an instruction from the instruction unit 56 after it is determined in the determination unit 55 of the control unit 50 whether a time during which the post-pressure-feeding temperature is higher than the baking temperature T exceeds a predetermined threshold value. In the second embodiment, an upper limit value of the adjustment time may be determined in advance. The abnormal determination and notification process (S6) may be executed in the control unit 50 when the time measured in the measurement unit 52 becomes longer than the upper limit value of the adjustment time.

The baking temperature holding process (S7) may end after a certain time has elapsed since a time when the temperature of the metal mold 10 has reached the baking temperature T, and the next process may follow.

REFERENCE SIGNS LIST

1 . . . Core molding device, 10 . . . Metal mold, 11 . . . Left mold, 12 . . . Right mold, 13 . . . Cavity, 20 . . . Pressure-feeding device, 30 . . . Mold heat controller, 40 . . . Mold temperature sensor, 50 . . . Control unit, 51 . . . Acquisition unit, 52 . . . Measurement unit, 53 . . . Setting unit, 54 . . . Reception unit, 55 . . . Determination unit, 56 . . . Instruction unit, 60 . . . Recording unit, 70 . . . Notification unit, 80 . . . Mixing container, 81 . . . Mixing container heater, 82 . . . Mixing container temperature sensor, T . . . Baking temperature.

The invention claimed is:

1. A core molding method of molding a core using a metal mold pressure-fed with mulled sand, the method comprising:

heating the metal mold such that a temperature of the metal mold reaches a temperature higher than a predetermined baking temperature;

pressure-feeding the heated metal mold with the mulled sand;

holding the temperature of the metal mold having been pressure-fed with the mulled sand at the predetermined baking temperature;

removing the core from the metal mold after the holding; and measuring a first temperature of the metal mold at end of the heating, wherein:

the holding includes measuring an adjustment time taken to change the temperature of the metal mold having been pressure-fed with the mulled sand to the predetermined baking temperature from start of temperature control of the metal mold;

the heating, the measuring the first temperature, the pressure-feeding, the holding, and the removing are executed sequentially and repeatedly; and in the heating after the removing, a preliminary temperature of the metal mold is determined based on the measured first temperature and the measured adjustment time, and the metal mold is heated based on the determined preliminary temperature.

2. The core molding method according to claim 1, further comprising heating the mulled sand before the pressure-feeding.

3. A core molding device for molding a core using a metal mold pressure-fed with mulled sand, the device comprising:

the metal mold for baking the mulled sand;

a pressure-feeding device configured to pressure-feed the mulled sand into the metal mold;

a mold heat controller configured to control a temperature of the metal mold;

a mold temperature sensor configured to measure the temperature of the metal mold;

a control unit connected to the pressure-feeding device, the mold heat controller, and the mold temperature sensor, wherein the control unit is configured to execute:

heating the metal mold using the mold heat controller such that the temperature of the metal mold reaches a temperature higher than a predetermined baking temperature, pressure-feeding the mulled sand into the heated metal mold using the pressure-feeding device, holding the temperature of the metal mold having been pressure-fed with the mulled sand at the baking temperature using the mold heat controller and the mold temperature sensor, and removing the core from the metal mold after the holding; and a recording unit connected to the mold temperature sensor and the control unit and recording the temperature of the metal mold, wherein the control unit is further configured to execute:

measuring a first temperature of the metal mold at end of the heating using the mold temperature sensor and recording the first temperature in the recording unit, and measuring a second temperature of the metal mold at end of the pressure-feeding using the mold temperature sensor and recording the second temperature in the recording unit;

the control unit is configured to sequentially and repeatedly execute the heating, the measuring the first temperature the pressure-feeding, the measuring the second temperature, the holding, and the removing; and in the heating after the removing, the control unit is configured to determine a preliminary temperature of the metal mold based on the first temperature and the second temperature recorded in the recording unit and the baking temperature, and heat the metal mold using the mold heat controller based on the determined preliminary temperature.

4. The core molding device according to claim 1, further comprising a notification unit connected to the control unit and configured to notify an abnormality, wherein, after the measuring the second temperature, the control unit further configured to execute causing the notification unit to notify an abnormality when the second temperature is higher than the baking temperature and a difference between the second temperature and the baking temperature is larger than a predetermined first threshold value.

5. The core molding device according to claim 3, further comprising:

a mixing container configured to store the mulled sand and discharge the mulled sand by the pressure-feeding device; and a mixing container heater connected to the mixing container and the control unit and configured to heat the mixing container, wherein before the pressure-feeding, the control unit is further configured to execute heating the mixing container by the mixing container heater to heat the mulled sand.

6. A core molding device for molding a core using a metal mold pressure-fed with mulled sand, the device comprising:

the metal mold for baking the mulled sand;

a pressure-feeding device configured to pressure-feed the mulled sand into the metal mold;

a mold heat controller configured to control a temperature of the metal mold;

a mold temperature sensor configured to measure the temperature of the metal mold;

a control unit connected to the pressure-feeding device, the mold heat controller, and the mold temperature sensor, wherein the control unit is configured to execute:

heating the metal mold using the mold heat controller such that the temperature of the metal mold reaches a temperature higher than a predetermined baking temperature, pressure-feeding the mulled sand into the heated metal mold using the pressure-feeding device, holding the temperature of the metal mold having been pressure-fed with the mulled sand at the baking temperature using the mold heat controller and the mold temperature sensor, and removing the core from the metal mold after the holding; and a recording unit connected to the mold temperature sensor and the control unit and recording the temperature of the metal mold and a time corresponding to a change in the temperature of the metal mold, wherein:

the control unit is further configured to comprise measuring a first temperature of the metal mold at end of the heating using the mold temperature sensor and recording the first temperature in the recording unit;

the holding using the mold temperature sensor includes measuring an adjustment time taken to change the temperature of the metal mold having been pressure-fed with the mulled sand to the predetermined baking temperature from start of temperature control of the metal mold, and recording the adjustment time in the recording unit;

the heating, the measuring the first temperature, the pressure-feeding, the holding, and the removing are executed sequentially and repeatedly; and in the heating after the removing, a preliminary temperature of the metal mold is determined based on the first temperature and the adjustment time recorded in the recording unit, and the metal mold is heated using the mold heat controller based on the determined preliminary temperature.

* * * * *